US007887034B2

(12) United States Patent
Krause et al.

(10) Patent No.: US 7,887,034 B2
(45) Date of Patent: Feb. 15, 2011

(54) INDIRECTLY HEATED CATHODE CLAMP SYSTEM AND METHOD

(75) Inventors: Stephen Krause, Ipswich, MA (US); Eric R. Cobb, Danvers, MA (US); Russell Low, Rowley, MA (US)

(73) Assignee: Varian Semiconductor Equipment Associates, Inc., Gloucester, MA (US)

( * ) Notice: Subject to any disclaimer, the term of this patent is extended or adjusted under 35 U.S.C. 154(b) by 1510 days.

(21) Appl. No.: 11/194,260

(22) Filed: Aug. 1, 2005

(65) Prior Publication Data

US 2008/0072413 A1 Mar. 27, 2008

(51) Int. Cl.
*B25B 3/00* (2006.01)

(52) U.S. Cl. ..... 269/6; 269/3; 29/270; 29/466; 81/9.44; 81/427

(58) Field of Classification Search ..... 269/3, 269/6, 95; 29/270–278, 466, 464, 764; 81/418, 81/427.5, 440, 9.44, 416, 305, 427; 30/90.1; 7/107, 126, 166

See application file for complete search history.

(56) References Cited

U.S. PATENT DOCUMENTS

| | | | | |
|---|---|---|---|---|
| 5,497,522 | A * | 3/1996 | Chen | 7/128 |
| 5,826,338 | A * | 10/1998 | Chilton et al. | 30/90.1 |
| 6,202,517 | B1 * | 3/2001 | Dolan | 81/427 |
| 6,618,885 | B1 * | 9/2003 | Blaustein | 7/107 |
| 7,356,915 | B2 * | 4/2008 | Murg | 29/764 |
| 2005/0005738 | A1 * | 1/2005 | Murg | 81/9.44 |
| 2008/0072413 | A1 * | 3/2008 | Krause et al. | 29/466 |

* cited by examiner

*Primary Examiner*—Lee D Wilson

(57) ABSTRACT

A method and clamp system for use on an ion implanter system for aligning a cathode and filament relative to one another in-situ are disclosed. The invention includes a clamp system having a clamp including a first clamp member separably coupled to a second clamp member, and an opening to a mount portion of one of the cathode and the filament in at least one of the clamp members. Each clamp member includes a surface to engage a mount portion of one of the cathode and the filament. The opening is adapted to receive a positioning tool to position the cathode and the filament relative to one another by moving the mount portion when the clamp is released. The mount portion may include a tool receiving member to facilitate accurate positioning.

12 Claims, 3 Drawing Sheets

INDIRECTLY HEATED CATHODE CLAMP SYSTEM AND METHOD

BACKGROUND OF THE INVENTION

1. Technical Field

The present invention relates generally to indirectly heated cathode ion sources, and more particularly, to a clamp system for an indirectly heated cathode and filament.

2. Related Art

In conventional ion implanting systems, proper set-up and spacing between an indirectly heated cathode and filament is difficult. In particular, the cathode and filament are held in place relative to one another by clamps, and the set up requires a setup fixture and a subjective gauge or process, which induce error in the set up. Complicating matters is the fact that the fixtured parts (e.g., cathode, filament, clamps, insulating block, etc.) require partial disassembly to be installed on the tool, defeating the purpose of the fixture. Accordingly, repeatability of the setup is practically impossible.

In view of the foregoing, there is a need in the art for an improved method and mechanism to align a cathode and filament.

SUMMARY OF THE INVENTION

The invention includes a method and clamp system for use on an ion implanter system for aligning a cathode and filament relative to one another in-situ. The invention includes a clamp system having a clamp including a first clamp member separably coupled to a second clamp member, and an opening to a mount portion of one of the cathode and the filament in at least one of the clamp members. Each clamp member includes a surface to engage a mount portion of one of the cathode and the filament. The clamp opening is adapted to receive a positioning tool to position the cathode and the filament relative to one another by moving the mount portion of one of the cathode and filament prior to releasing the cathode clamp. The mount portion may include a tool receiving member to facilitate accurate positioning.

A first aspect of the invention is directed to a method for aligning an indirectly heated cathode and a filament relative to one another, the method comprising the steps of: releasing a positioning clamp that positions a mount portion of one of the cathode and the filament; and aligning the cathode and the filament relative to one another by using a tool within an opening of the positioning clamp to position the mount portion.

A second aspect of the invention is directed to a clamp system for an indirectly heated cathode and a filament, the clamp system comprising: a clamp including a first clamp member separably coupled to a second clamp member, each clamp member including a surface to engage a mount portion of one of the cathode and the filament; and an opening to the mount portion in at least one of the clamp members, the opening adapted to receive a positioning tool to position the cathode and the filament relative to one another.

A third aspect of the invention is directed to an ion implanter system comprising: a source including a clamp system for an indirectly heated cathode and a filament, the clamp system comprising: a clamp including a first clamp member separably coupled to a second clamp member, each clamp member including a surface to engage a mount portion of one of the cathode and the filament; and an opening to the mount portion in at least one of the clamp members, the opening adapted to receive a positioning tool to position the cathode and the filament relative to one another.

The foregoing and other features of the invention will be apparent from the following more particular description of embodiments of the invention.

BRIEF DESCRIPTION OF THE DRAWINGS

The embodiments of this invention will be described in detail, with reference to the following figures, wherein like designations denote like elements, and wherein.

DETAILED DESCRIPTION OF THE INVENTION

Figure 1:
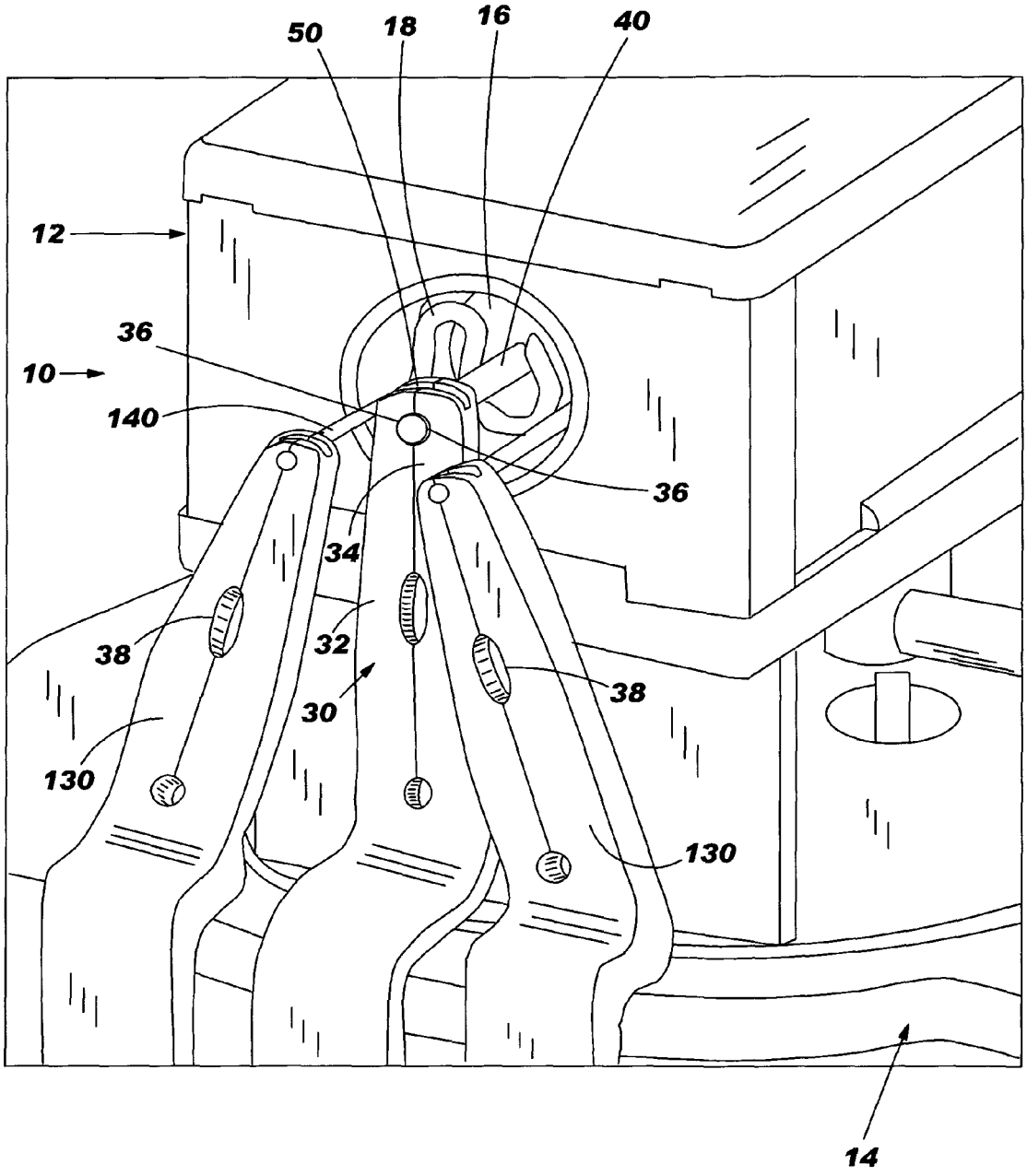
FIG. 1 shows a perspective view of a clamp system according to the invention.

With reference to the accompanying drawings, FIG. 1 shows a perspective view of a clamp system 10 according to the invention coupled to a source 12 of an ion implanter system 14. Clamp system 10 aligns an indirectly heated cathode 16 and a filament 18, as will be described below. Clamp system 10 includes a cathode clamp 30 including a first clamp member 32 separably coupled to a second clamp member 34. As shown in FIG. 1, each clamp member 32, 34 includes a surface 36 to engage a mount portion 40, 140 of one of cathode 16 and filament 18, respectively. In one embodiment, each clamp 30 includes a sawcut-type clamp including at least one opening 38 for receiving a tool adapted to forcibly separate members of the sawcut-type clamp. However, it should be recognized that other type clamps are possible.

As illustrated, the teachings of the invention are applied to cathode positioning clamp 30 and, accordingly, mount portion 40 is that of cathode 16. However, as one with skill in the art will recognize the teachings of the invention could be applied equally to filament positioning clamp 130 and filament 18 mount portion 140, or a combination of both positioning clamps 30, 130.

Figure 2:
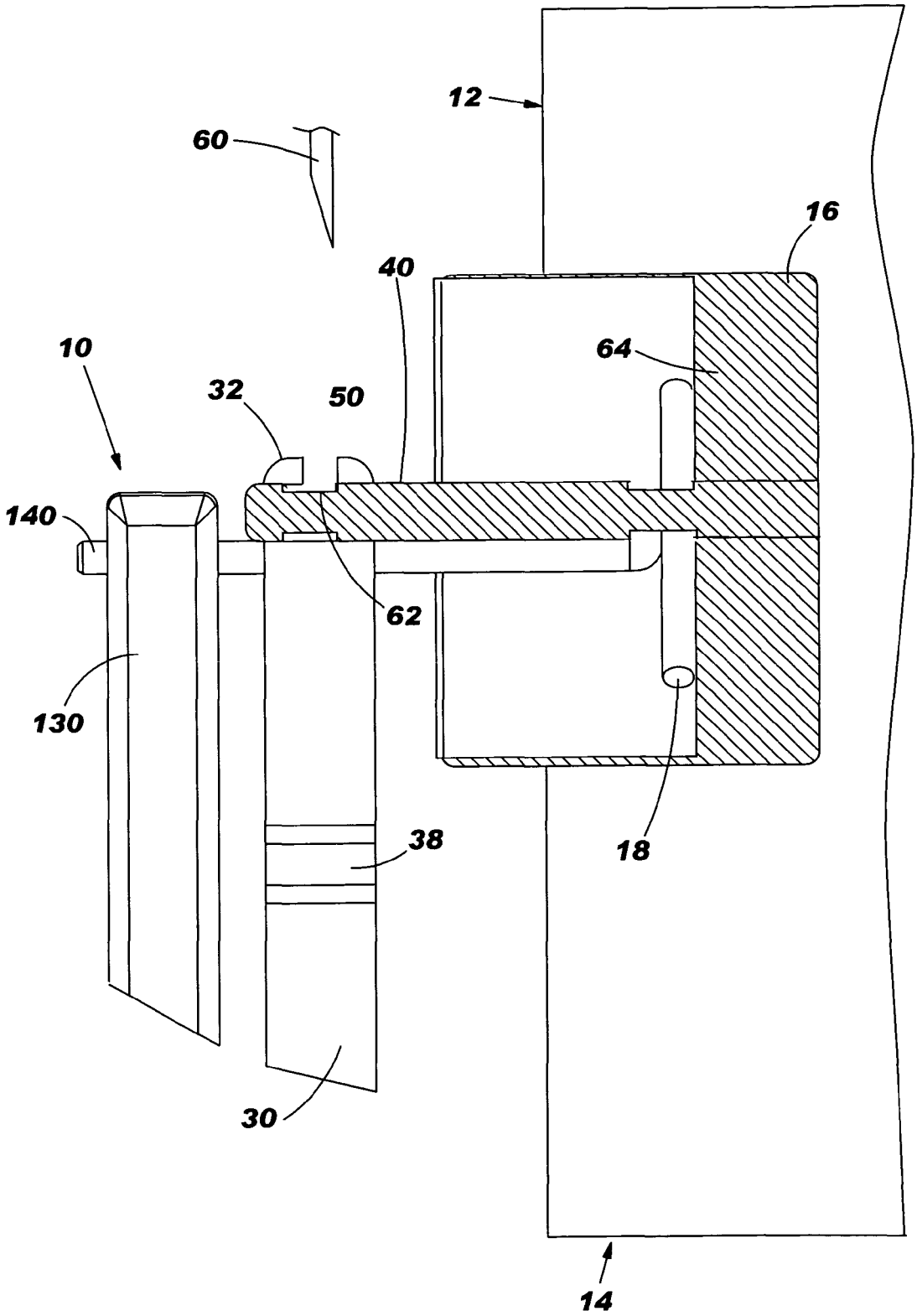
FIG. 2 shows a cross-sectional view of a cathode positioning clamp including an opening according to the invention, with a mount portion of the cathode positioned to align the cathode and filament.
Figure 3:
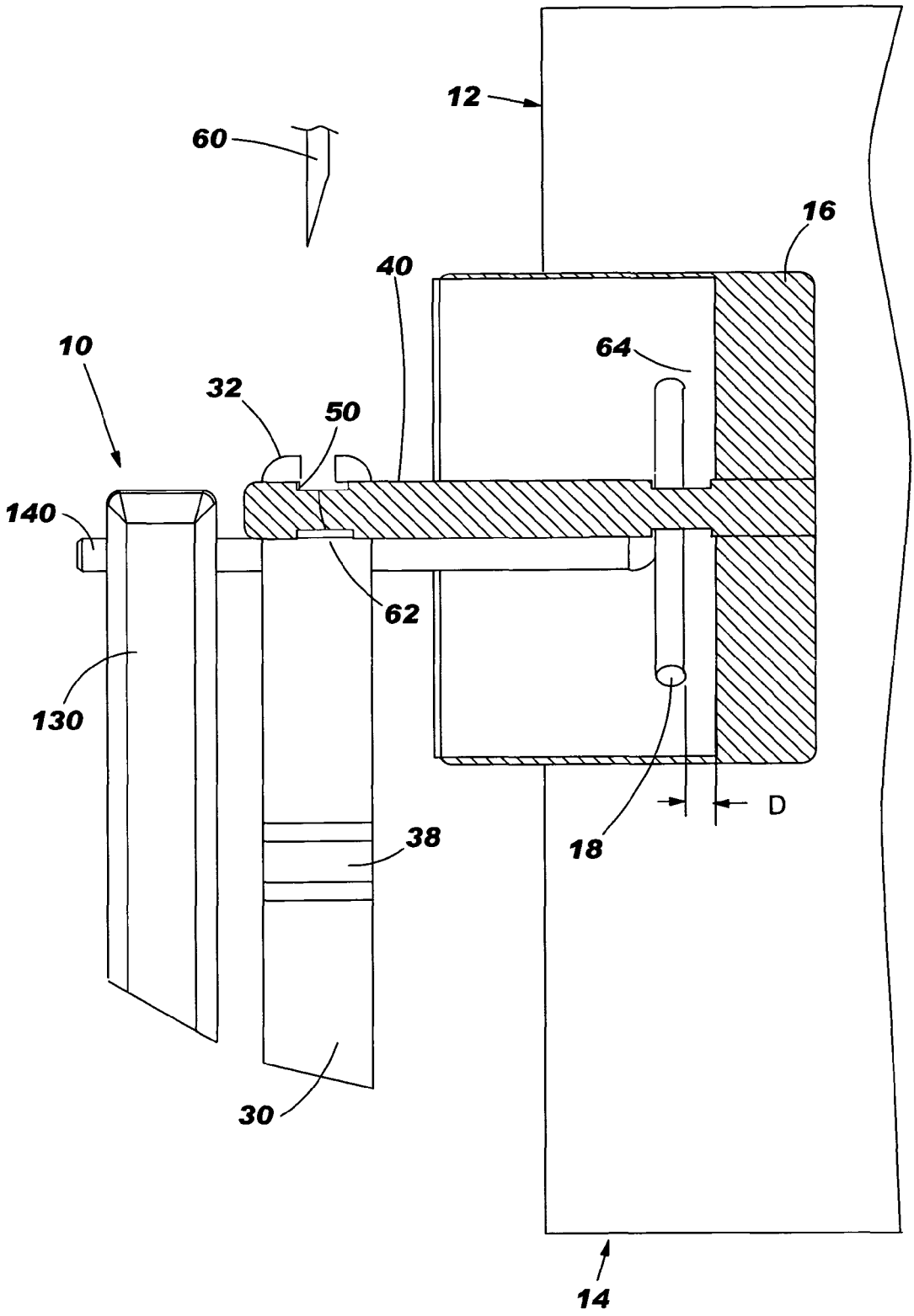
FIG. 3 shows a cross-sectional view of the cathode positioning clamp of FIG. 2 with a mount portion of the cathode in a final position relative to the filament.

Clamp system 10 further includes an opening 50 to mount portion 40 in at least one of clamp members 32, 34. Opening 50 is adapted to receive a positioning tool 60 to position cathode 16 relative to clamp 30 and, according, relative to filament 18. Mount portion 40 may include a tool receiving member 60 (FIGS. 2-3) for engagement by positioning tool 60. When clamp 30 is released cathode 16 and filament 18 can be positioned relative to one another by positioning tool 60 engaging mount portion 40. In one embodiment, positioning tool 60 engages a tool receiving member 62 in the form of a groove in mount portion 40 and aligns the groove with an edge of opening 50. The size of opening and position of the groove are such that the alignment positions cathode 16 and filament 18 in a predetermined position. For example, as shown in FIG. 2, filament 18 may be positioned in contact with a back surface 64 of cathode 16 in an initial setup position. When moved to an aligned position, shown in FIG. 3, by way of positioning tool 60 engaging the tool receiving member 62, filament 18 is positioned at a predefined distance D from back surface 64 based on the position of tool receiving member 62 on mount portion 40. Subsequently, clamp 30 can be re-clamped. Positioning tool 60 may take any form capable of insertion into opening 50 and engagement with mount portion 40. No special tool is required.

The above-described invention provides a method that allows alignment of an indirectly heated cathode 16 to filament 18 in-situ, using positioning tool 60 along with opening 50 in a clamp 30, 130. Utilization of these features and tools reduces alignment error during the assembly and installation of the apparatus. The invention allows in-situ, repeatable assembly and alignment, which are important for ion implanter system process success.

While this invention has been described in conjunction with the specific embodiments outlined above, it is evident that many alternatives, modifications and variations will be apparent to those skilled in the art. Accordingly, the embodiments of the invention as set forth above are intended to be illustrative, not limiting. Various changes may be made without departing from the spirit and scope of the invention as defined in the following claims.

What is claimed is:

1. A clamp system for an indirectly heated cathode and a filament, the clamp system comprising:

a clamp having a handle, said clamp including a first clamp member separably coupled to a second clamp member, each clamp member including a surface to engage a mount portion of one of the cathode and the filament wherein said clamp members are separated by a channel in between said members with said channel having an aperture in a side of said members defined by said engagement surfaces and configured to accept said mount portion, said engagement surfaces being distal from an intermediate aperture; and an opening to the mount portion in both of said first and second clamp members, the opening configured to receive a positioning tool to position the cathode and the filament relative to one another.

2. The clamp system of claim 1, wherein the mount portion includes a tool receiving member for engagement by the positioning tool, whereby the cathode and the filament can be positioned relative to one another by the positioning tool engaging the mount portion when the clamp is in a released state.

3. The clamp system of claim 2, wherein the tool receiving member includes a groove in the mount portion.

4. The clamp system of claim 2, wherein the cathode includes a back surface and the filament is positioned at a predefined distance from the back surface based on the position of the tool receiving member on the mount portion.

5. The clamp system of claim 1, wherein the opening is in a cathode positioning clamp.

6. The clamp system of claim 1, wherein the opening is in a filament positioning clamp.

7. The clamp system of claim 1, wherein the clamp includes a sawcut-type clamp.

8. The clamp system of claim 7, wherein the sawcut-type clamp includes the intermediate aperture for receiving a tool adapted to forcibly separate members of the sawcut-type clamp.

9. A system comprising an ion implanter system comprising:

a source including a clamp system for an indirectly heated cathode and a filament, the clamp system comprising:

a clamp having a handle, said clamp including a first clamp member separably coupled to a second clamp member, each clamp member including a surface to engage a mount portion of one of the cathode and the filament, wherein said clamp members are separated by a channel in between said members with said channel having an aperture in a side of said members defined by said engagement surfaces and configured to accept said mount portion, said engagement surfaces being distal from an intermediate aperture; and an opening to the mount portion in both of said first and second clamp members, the opening configured to receive a positioning tool to position the cathode and the filament relative to one another.

10. The system of claim 9, wherein the mount portion includes a tool receiving member for engagement by the positioning tool, whereby the cathode and the filament can be positioned relative to one another by the positioning tool engaging the mount portion when the clamp is in a released state.

11. The system of claim 10, wherein the tool receiving member includes a groove in the mount portion.

12. The system of claim 10, wherein the cathode includes a back surface and the filament is positioned at a predefined distance from the back surface based on the position of the tool receiving member on the mount portion.

* * * * *